United States Patent [19]

Bartlett et al.

[11] Patent Number: 4,935,073

[45] Date of Patent: Jun. 19, 1990

[54] PROCESS FOR APPLYING COATINGS OF ZIRCONIUM AND/OR TITANTUIM AND A LESS NOBLE METAL TO METAL SUBSTRATES AND FOR CONVERTING THE ZIRCONIUM AND/OR TITANIUM TO AN OXIDE, NITRIDE, CARBIDE, BORIDE OR SILICIDE

[75] Inventors: Robert W. Bartlett, Tucson, Ariz.; Paul J. Jorgensen, Cupertino, Calif.; Ibrahim M. Allam, Dhahran, Saudi Arabia; David J. Rowcliffe, Stockholm, Sweden

[73] Assignee: SRI International, Menlo Park, Calif.

[21] Appl. No.: 111,210

[22] Filed: Oct. 21, 1987

Related U.S. Application Data

[63] Continuation-in-part of Ser. No. 325,504, Nov. 27, 1981, Pat. No. 4,483,720, and Ser. No. 662,253, Oct. 17, 1984, abandoned, and Ser. No. 662,252, Oct. 17, 1984, abandoned.

[51] Int. Cl.[5] ..... C23C 8/06

[52] U.S. Cl. ..... 148/247; 148/277; 148/278; 148/280; 427/343; 427/376.4; 427/376.5; 427/376.6

[58] Field of Search ..... 427/376.3, 376.4, 376.5, 427/376.6, 376.7, 376.8, 383.7, 343; 148/6.3, 6.35

[56] References Cited

U.S. PATENT DOCUMENTS

| | | | |
|---|---|---|---|
| 4,229,234 | 10/1980 | Krutenat et al. | 148/280 |
| 4,342,792 | 8/1982 | Brown et al. | 427/376.4 |
| 4,459,328 | 7/1984 | Mizuhara | 427/343 |

FOREIGN PATENT DOCUMENTS

| | | | |
|---|---|---|---|
| 1086708 | 10/1967 | United Kingdom | 148/280 |
| 1396898 | 6/1975 | United Kingdom | 148/280 |
| 1439947 | 6/1976 | United Kingdom | 148/280 |

*Primary Examiner*—Sadie Childs

*Attorney, Agent, or Firm*—Edward B. Gregg; Urban H. Faubion; John Y. Chen

[57] ABSTRACT

Protective coatings are applied to substrate metals by coating the metal surface, e.g. by dipping the substrate metal in a molten alloy of the coating metals, and then exposing the coating at an elevated temperature to an atmosphere containing a reactive gaseous species which forms an oxide, a nitride, a carbide, a boride or a silicide. The coating material is a mixture of the metals $M_1$ and $M_2$, $M_1$ being zirconium and/or titanium, which forms a stable oxide, nitride, carbide, boride or silicide under the prevailing conditions. The metal $M_2$ does not form a stable oxide, nitride, carbide, boride or silicide. $M_2$ serves to bond the oxide, etc. of $M_1$ to the substrate metal. Mixtures of $M_1$ and/or $M_2$ metals may be employed. This method is much easier to carry out than prior methods and forms superior coatings. Eutectic alloys of $M_1$ and $M_2$ which melt substantially lower than the melting point of the substrate metal are preferred.

13 Claims, 1 Drawing Sheet

Figure 1:
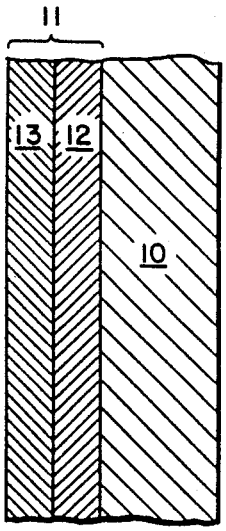

PROCESS FOR APPLYING COATINGS OF ZIRCONIUM AND/OR TITANTUIM AND A LESS NOBLE METAL TO METAL SUBSTRATES AND FOR CONVERTING THE ZIRCONIUM AND/OR TITANIUM TO AN OXIDE, NITRIDE, CARBIDE, BORIDE OR SILICIDE

This application is a continuation-in-part of our copending applications as follows: Ser. No. 325,504, filed Nov. 27, 1981, entitled "PROCESS FOR APPLYING THERMAL BARRIER COATINGS TO METALS AND RESULTING PRODUCT", now U.S. Pat. No. 4,483,720; Ser. No. 662,253, filed Oct. 17, 1984, entitled "PROCESS FOR APPLYING COATINGS TO METALS AND RESULTING PRODUCT" now abandoned; and Ser. No. 662,252, filed Oct. 17, 1984 by two of us (Allam and Rowcliffe), entitled "PROCESS FOR APPLYING HARD COATINGS AND THE LIKE TO METALS AND RESULTING PRODUCT" now abandoned.

This invention relates to the coating of metals (hereinafter referred to as "substrates" or "substrate metals") with coatings that serve to provide hard surfaces, thermal barriers, oxidation barriers, chemically resistant coatings, etc.

By way of example, certain alloys known as "superalloys" are used as gas turbine components where high temperature oxidation resistance and high mechanical strength are required. In order to extend the useful temperature range, the alloys must be provided with a coating which acts as a thermal barrier to insulate and protect the underlying alloy or substrate from high temperatures and oxidizing conditions to which they are exposed. Zirconium oxide is employed for this purpose because it has a thermal expansion coefficient approximating that of the superalloys and because it functions as an efficient thermal barrier. It has been applied heretofore to alloy substrates by plasma spraying, in which an inner layer or bond coat, for example NiCrAlY alloy, protects the superalloy substrate from oxidation and bonds to the superalloy and to the zirconium oxide. The zirconium oxide forms an outer layer or thermal barrier and the zirconia is partially stabilized with a second oxide such as calcia, yttria or magnesia. The plasma spray technique usually results in a nonuniform coating; and it is not applicable or it is difficultly applicable to re-entrant surfaces. The plasma sprayed coatings often have microcracks and pinholes that lead to catastrophic failure.

Thermal barrier coatings can also be applied using electron beam vaporization. This method of application is expensive and limited to line of sight application. Variations in coating compositions often occur because of differences in vapor pressures of the coating constituent elements.

Other methods of applying protective coatings to metal substrates include those described in the following British patents:

British Patent No. 1,086,708 describes substrate metals consisting of tungsten, molybdenum or alloys of the two metals; and forming an oxide layer on the surface of the substrate metal, e.g. by selective oxidation of the chromium content of the surface. Alternatively, as in Example 7, a metal such as palladium maybe applied by electroplating, then chromium also by electroplating, and the chromium is then oxidized by exposure to moist hydrogen. The preferentially oxidizable metal, i.e. the metal which forms an oxide, is used in an amount not exceeding 15% of the alloy used as the protective coating. Metals which are described as preferentially oxidizable are Th, Ti, Hf, Zr, U, Mg, Ce, Al and Be. I.e. they are metals which, when alloyed with a less oxidizable metal, can be selectively oxidized without, presumably, oxidizing the alloying metal.

British Patent No. 1,396,898 dips a ferrous metal substrate into a molten alloy of aluminum and chromium and then oxidizes the aluminum to aluminum oxide.

British Patent No. 1,439,947 applies to a ferrous or non-ferrous metal substrate a coating by plasma deposition. The coating so applied is an alloy of two metals one of which forms an oxide, a nitride, a carbide, a boride or a silicide more readily than the other metal; then the coating is subjected to an atmosphere which, it is asserted, forms the desired oxide, carbide, etc. with the one metal without forming it with the other metal. Metals mentioned at page 4, commencing at line 8 are Ni, Al, Co, Fe, Cr, Cu, Mo, W, Nb, Si, Ta, Ti, Zn, Mn, Zr, V and Hf and their alloys.

It is an object of the present invention to provide an improved method of applying to substrate metals coatings of oxide, carbide, nitride, boride or silicide.

It is a further object of the invention to provide coated substrate metals in which the coatings, as described above, are uniform and adherent to the substrate.

The above and other objects of the invention will be apparent from the ensuing description and the appended claims.

In accordance with the present invention a coating alloy or a coating mixture of two or more metals is provided. At least one of these metals is zirconium, titanium or a mixture or alloy of zirconium and titanium. The aforesaid coating alloy or coating mixture also contains a metal $M_2$ having the properties described below.

Zirconium and titanium form stable oxides, carbides, nitrides, borides and silicides. For example they form stable oxides at high temperatures in an atmosphere having a very low concentration of oxygen, e.g. a $CO_2/CO$ mixture or an $H_2/H_2O$ mixture which, respectively undergo the reaction $$CO_2 \rightleftharpoons CO + \tfrac{1}{2}O_2 \quad (1)$$

$$H_2O \rightleftharpoons H_2 + \tfrac{1}{2}O_2 \quad (2)$$

By contrast the metal $M_2$ in the coating alloy or mixture does not form stable oxides, carbides, nitrides, borides or silicides under such conditions.

Hereinafter the metals Zr and Ti are sometimes referred to collectively as $M_1$ and the elements O, N, C, B and Si are sometimes referred to collectively as X.

This coating alloy or coating mixture is then melted to provide a uniform melt which is then applied to a metal substrate, e.g. by dipping the substrate into the melt. Alternatively, the coating mixture or coating alloy is reduced to a finely divided state, and the finely divided metal is incorporated in a volatile solvent to form a slurry which is applied to the metal substrate by spraying or brushing. The resulting coating is heated in an inert atmosphere to accomplish evaporation of the volatile solvent and the fusing of the alloy or metal mixture onto the surface of the substrate. (Where physical mixtures of metals are used, they are converted to an alloy by melting or they are alloyed or fused together in situ as in the slurry method of application described above.)

In certain instances, as where the alloy melts at a high temperature such that the substrate metal might be adversely affected by melting the coating of alloy, the alloy may be applied by plasma spraying. Preferably, however, eutectic coating alloys are employed which melt below the melting point of the substrate metal.

It will be understood that $M_2$ may be a mixture or alloy of two or more metals meeting the requirements of $M_2$.

The coating thus formed and applied is then preferably subjected to an annealing step. The annealing step may be omitted when annealing occurs under conditions of use.

When a coating of suitable thickness has been applied to the substrate metal by the dip coating process or by the slurry process described above (and in the latter case after the solvent has been evaporated and the $M_1/M_2$ metal alloy or mixture is fused onto the surface of the substrate) or by any other suitable process the surface is then exposed to a selectively reactive atmosphere at an appropriate elevated temperature. Where an oxide coating is desired (i.e. X=0) a mixture of carbon dioxide and carbon monoxide (hereinafter referred to as $CO_2/CO$) may be used. A typical $CO_2/CO$ mixture contains 90 percent of $CO_2$ and 10 percent of CO. When such a mixture is heated to a high temperature, an equilibrium mixture results in accordance with equation (1) above. The concentration of oxygen in this equilibrium mixture is very small, e.g., at 800° C. the equilibrium oxygen partial pressure is approximately $2\times10^{-17}$ atmosphere, but is sufficient at such temperature to bring about selective oxidation of $M_1$. Other oxidizing atmospheres may be used, e.g., mixtures of oxygen and inert gases such as argon or mixtures of hydrogen and water vapor which provide oxygen partial pressures lower than the dissociation pressures of the oxides of the metals $M_2$, and higher than the dissociation pressure of the oxide of $M_1$.

Where it is desired to form a nitride, carbide, boride or silicide layer on the substrate metal, an appropriate, thermally dissociable compound or molecule of nitrogen, carbon, boron or silicon may be used. Examples of suitable gaseous media are set forth in Table I below including media where X=oxygen, nitrogen, etc.

TABLE I

| X | Gaseous Media for Forming Oxides, Nitrides, Carbides, Borides and Silicides. Gaseous Media |
|---|---|
| O | $H_2/H_2O$, $CO/CO_2$, $O_2$/inert gas. |
| N | $N_2$, $NH_3$ or mixtures of the two. |
| C | Methane, acetylene. |
| B | Borane, diborane, borohalides. |
| Si | Silane, trichlorosilane, tribromosilane, silicon tetrachloride. |

The partial pressure of the reactive species is such that $M_1$ forms a stable compound of oxygen, nitrogen, carbon, boron or silicon and $M_2$ does not form such a stable compound. If a very low partial pressure of the reactive species is needed, that species may be diluted by an inert gas, e.g. argon or its concentration may be adjusted as in the case of a $CO/CO_2$ mixture or an $H_2/H_2O$ mixture where the partial pressure of oxygen is adjusted by adjusting the ratio of CO and $CO_2$ or $H_2$ and $H_2O$.

The temperature chosen should, of course, be sufficient to form the desired compound of $M_1$ but above the temperature of decomposition of the corresponding compound (if one is formed at all) of $M_2$. The temperature should be at or below the melting point of the coating alloy but the temperature is also preferably sufficiently high to produce the desired coating within a treatment time of eight hours.

Reverting to the choice of what may be called the binding metal $M_2$ (so-called because it remains in metallic form and serves to bond the zirconium and/or titanium oxide, carbide, etc. to the substrate metal), although many metals may be used it is preferred to use copper, nickel, cobalt or iron.

Thus eutectic alloys of iron, nickel and/or cobalt readily wets and adheres to iron, nickel and cobalt based alloys used as substrates. Eutectic alloys of copper readily wet and adhere to substrates of copper and other non-ferrous alloys. Also iron, nickel, cobalt and copper are readily obtainable and are inexpensive. Further the eutectic melting points of alloys of these metals generally lie below the temperature of degradation of many substrates. Also the free energy of formation of the oxides, nitrides and carbides of titanium and zirconium is much greater than the free energy of formation of the oxides, nitrides and carbides of the aforesaid $M_2$ metals.

Also it is preferred that the zirconium and/or titanium be present in the coating alloy or mixture in very substantial amounts, e.g. 50% or more and preferably 70% or more, by weight.

There results from this process a structure such as shown in FIG. 1 of the drawings.

Referring now to FIG. 1, this figure represents a cross-section through a substrate alloy indicated at 10 coated with a laminar coating indicated at 11. The laminar coating 11 consists of an intermediate metallic layer 12 and an outer $M_1/X_n$ layer 13 ($M_1$ being Zr and/or Ti.) The relative thicknesses of the layers 12 and 13 are exaggerated. The substrate layer 10 is as thick as required for the intended service.

Where oxide thermal barriers are formed, i.e. the reactive gaseous species is oxygen, the layers 12 and 13 together typically will be about 300 to 400 microns thick, the layer 12 will be about 250 microns thick, and the layer 13 will be about 150 microns thick. Where a hard coating of carbide, nitride, etc. is formed, the layers 12 and 13 will be thinner, e.g. 1 to 10 microns. It will be understood that the layer 12 will have a thickness adequate to form a firm bond with the substrate and that the layer 13 will have a thickness suiting it to its intended use. If, for example, an oxide layer is provided which will act as a thermal barrier, a thicker layer may be desired than in the case where the purpose is to provide a hard surface.

Figure 1A:
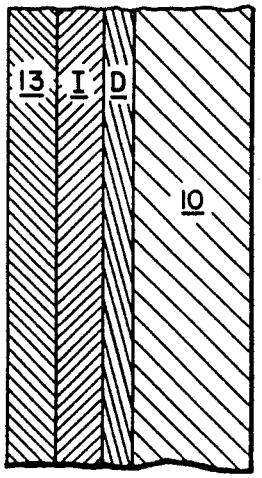

FIG. 1 is a simplified representation of the coating and substrate. A more accurate representation is shown in FIG. 1A in which the substrate 10 and outer layer $M_1/X_n$ are as described in FIG. 1. However there is a diffusion zone D which may be an alloy of one or more substrate metals and the metal $M_2$ inwardly into the substrate. There is also an intermediate zone I which may be a cermet formed as a composite of $M_1X_n$ and $M_2$.

Table II below lists metals that may be used as $M_2$.

TABLE II

| ($M_2$) | |
|---|---|
| Cobalt | Nickel |
| Copper | Palladium |

TABLE II-continued

| ($M_2$) | |
|---|---|
| Iron | Platinum |
| Molybenum | Rhodium |

As stated above eutectic alloys which melt below the melting point, preferably substantially below the melting point of the substrate metal are preferred.

Examples of eutectic alloys are listed in Table III. It will be understood that not all of these alloys are useful on all substrates. In some cases the melting points are approximate. Numbers indicate the approximate percentage by weight of $M_2$.

TABLE III

| Eutectic Alloy | Melting Point (°C.) |
|---|---|
| Ti - 28.5 Ni | 942 |
| Ti - 32 Fe | 1085 |
| Ti - 28 Co | 1025 |
| Ti - 50 Cu | 955 |
| Ti - 72 Cu | 885 |
| Ti - 48 Pd | 1080 |
| Zr - 17 Ni | 960 |
| Zr - 27 Ni | 1010 |
| Zr - 16 Fe | 934 |
| Zr - 27 Co | 1061 |
| Zr - 54 Cu | 885 |
| Zr - 27 Pd | 1030 |
| Zr - 37 Pt | 1185 |
| Zr - 25 Rh | 1065 |

Alloys of three or more of these metals may be used if they have suitable melting points, e.g. do not have melting points which are so high as to be destructive of the substrate metal.

Yttrium, calcium and magnesium are especially beneficial in ziconium-noble metal ($M_2$) alloys because they stabilize zirconia in the cubic form. Examples of such ternary alloys are as follows.

| Zr | Y | Ca | Mg | Ni |
|---|---|---|---|---|
| 76 | 8 | | | 16 |
| 77 | | 7 | | 16 |
| 79 | | | 5 | 16 |

Table IV provides examples of metal substrates to which the metal pairs may be applied.

TABLE IV

| |
|---|
| Superalloys |
| Cast nickel base such as IN 738 |
| Cast cobalt base such as MAR-M509 |
| Wrought nickel base such as Rene 95 |
| Wrought cobalt base such as Haynes alloy No. 188 |
| Wrought iron base such as Discaloy |
| Hastalloy X |
| RSR 185 |
| Incoloy 901 |
| Coated Superalloys (coated for corrosion resistance) |
| Superalloys coated with Co(or Ni)—Cr—Al—Y alloy, e.g. 15-25% Cr, 10-15% Al, 0.5% Y, balance is Co or Ni |
| Steels |
| Tool Steels (wrought, cast or powder metallurgy) such as AISIM2; AISIW1 |
| Stainless Steels |
| Austenitic 304 |
| Ferritic 430 |
| Martensitic 410 |
| Carbon Steels |
| AISI 1018 |
| Alloy Steels |
| AISI 4140 |
| Maragin 250 |
| Cast Irons |
| Gray, ductile, malleable, alloy |
| UNSF 10009 |
| Non-ferrous Metals |
| Titanium and titanium alloys, e.g. ASTM Grade 1; Ti-6Al-4V |
| Nickel and nickel alloys, e.g. nickel 200, Monel 400 |
| Cobalt |
| Copper and its alloys, e.g. C 10100; C 17200; C 26000; C95200 |
| Refractory Metals and Alloys |
| Molybdenum alloys, e.g. TZM |
| Niobium alloys, e.g. FS-85 |
| Tantalum alloys, e.g. T-111 |
| Tungsten alloys, e.g. W—Mo alloys |
| Cemented Carbides |
| Ni and cobalt bonded carbides, e.g. WC-3 to 25 Co |
| Steel bonded carbides, e.g. 40-55 vol. % TiC, balance steel; 10-20% TiC-balance steel |

The dip coating method is preferred. It is easy to carry out and the molten alloy removes surface oxides (which tend to cause spallation). In this method a molten $M_1/M_2$ alloy is provided and the substrate alloy is dipped into a body of the coating alloy. The temperature of the alloy and the time during which the substrate is held in the molten alloy will control the thickness and smoothness of the coating. If an aerodynamic surface or a cutting edge is being prepared a smoother surface will be desired than for some other purposes. The thickness of the applied coating can range between a fraction of one micron to a few millimeters. Preferably, a coating of about 300 microns to 400 microns is applied if the purpose is to provide a thermal barrier. A hardened surface need not be as thick. It will be understood that the thickness of the coating will be provided in accordance with the requirements of a particular end use.

The slurry fusion method has the advantage that it dilutes the coating alloy or metal mixture and therefore makes it possible to effect better control over the thickness of coating applied to the substrate. Also complex shapes can be coated and the process can be repeated to build up a coating of desired thickness. Typically, the slurry coating technique may be applied as follows: A powdered alloy of $M_1$ (zirconium, titanium or an alloy of the two metals) and $M_2$ is mixed with a mineral spirit and an organic cement such as Nicrobraz 500 (Well Colmonoy Corp.) and MPA-60 (Baker Caster Oil Co.). Typically proportions used in the slurry are coating alloy 45 weight percent, mineral spirit 10 weight percent, and organic cement, 45 weight percent. This mixture is then ground, for example, in a ceramic ball mill using aluminum oxide balls. After separation of the resulting slurry from the alumina balls, it is applied (keeping it stirred to insure uniform dispersion of the particles of alloy in the liquid medium) to the substrate surface and the solvent is evaporated, for example, in air at ambient temperature or at a somewhat elevated temperature. The residue of alloy and cement is then fused onto the surface by heating it to a suitable temperature in an inert atmosphere such as argon that has been passed over hot calcium chips to getter oxygen. The cement will be decomposed and the products of decomposition are volatilized.

If the alloy of $M_1$ and $M_2$ has a melting point which is sufficiently high that it exceeds or closely approaches the melting point of the substrate, it may be applied by sputtering, by vapor deposition or some other technique.

It is advantageous to employ $M_1$ and $M_2$ in the form of an alloy which is a eutectic or near eutectic mixture. This has the advantage that a coating of definite, predictable composition is uniformly applied. Also eutectic and near eutectic mixtures have lower melting points than non-eutectic mixtures. Therefore they are less likely than high melting alloys to harm the substrate metal and they sinter more readily than high melting alloys.

The following specific examples will serve further to illustrate the practice and advantages of the invention.

Example 1 is provided to show details of the technique used in the practice of the invention. It relates to cerium rather than zirconium and titanium but is pertinent for the reasons stated.

EXAMPLE 1.

The substrate was a nickel base superalloy known as IN 738, which has a composition as follows:

| | | | |
|---|---|---|---|
| 61% | Ni | 1.75% | Mo |
| 8.5% | Co | 2.6% | W |
| 16% | Cr | 1.75% | Ta |
| 3.4% | Al | 0.9% | Nb |
| 3–4% | Ti | | |

The coating alloy was in one case an alloy containing 90 percent cerium and 10 percent cobalt, and in another case an alloy containing 90 percent cerium and 10 percent nickel. The substrate was coated by dipping a bar of the substrate alloy into the molten coating alloy. The temperature of the coating alloy was 600° C., which is above the liquidus temperatures of the coating alloys. By experiment it was determined that a dipping time of about one minute provided a coating of satisfactory thickness.

The bar was then extracted from the melt and was exposed to a $CO_2/CO$ mixture containing 90.33 percentage $CO_2$ and 9.67 percent CO. The exposure periods ranged from 30 minutes to two hours and the temperature of exposure was 800° C. The equilibrium oxygen partial pressure of the $CO_2/CO$ mixture at 800° C. is about $2.25\times10^{-17}$ atmosphere, and at 900° C. it is about $7.19\times10^{31\ 15}$ atmosphere. The dissociation pressures of CoO were calculated at 800° and 900° to be about $2.75\times10^{-16}$ atmosphere and about $3.59\times10^{-14}$ atmosphere, respectively, and the dissociation pressures of NiO were calculated to be about $9.97\times10^{-15}$ atmosphere and about $8.98\times10^{-13}$ atmosphere, respectively. Under these circumstances neither cobalt nor nickel was oxidized.

Each coated specimen was then annealed in the absence of oxygen in a horizontal tube furnace at 900° or 1000° C. for periods up to two hours. This resulted in recrystallization of oxide grains in the intermediate layer.

Figure 2:
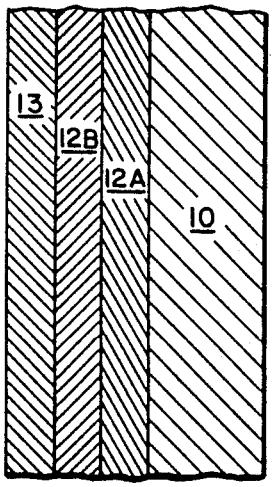

Examination of the treated specimens, treated in this manner with the cerium-cobalt alloy, revealed a structure in cross-section as shown in FIG. 2. In FIG. 2, as in FIG. 1, the thickness of the various layers is not to scale, thickness of the layers of the coating being exaggerated.

Referring to FIG. 2, the substrate is shown at 10, an interaction zone at 12A, a subscale zone at 12B and a dense oxide zone at 13. The dense oxide zone consists substantially entirely of $CeO_2$; the subscale zone 12B contains both $CeO_2$ and metallic cobalt and the interaction zone 12A contains cobalt and one or more metals extracted from the substrate.

Similar results are obtained using a cerium-nickel alloy containing 90% cerium and 10% nickel.

EXAMPLE 2

The coating alloy composition was 70% Zr-25% Ni-5% Y by weight. Yttrium was added to the Zr-Ni coating alloy to provide a dopant to stabilize $ZrO_2$ in the cubic structure during the selective oxidation stage, and also because there is some evidence that yttrium improves the adherence of plasma-sprayed $ZrO_2$ coatings. The weight ratio of Zr to Ni in this alloy was 2.7, which is similar to that of the $NiZr_2$-NiZr eutectic composition. The 5% Y did not significantly alter the melting temperature of the Zr-Ni eutectic. The substrates were dipped into the molten coating alloy at 1027° C.

Two substrate alloys were coated, namely MAR-M509 and Co-10% Cr-3% Y. The results obtained indicated that the $ZrO_2$-based coatings applied by this technique to Co-Cr-Y alloy are highly adherent, uniform and have very low porosity. Little or no diffusion zone was observed between the coating and the substrate alloy. The coating layer was established totally above the substrate surface, and its composition was not significantly altered by the substrate constituents.

EDAX-concentration profiles were determined of different elements within the Zr-rich layer after hot dipping the substrate alloy (Co-10Cr-3Y) in the coating alloy, followed by an annealing treatment. The coating layer was about 150–160 thick with a relatively thin (=20) diffusion zone at the interface with the underlying substrate. Cr was virtually nonexistent within the coating layer and a small amount of Co diffused from the substrate right through the coating to the external surface.

Selective oxidation was conducted at 1027° C. in a gas mixture of hydrogen/water vapor/argon at appropriate proportions to provide and oxygen partial pressure of about $10^{-17}$ atm. At this pressure, both nickel and cobalt are thermodynamically stable in the metallic form. The scale produced by this process consists of an outer oxide layer about 40μ thick and an inner subscale composite layer of about 120μ thick. The outer layer contained only $ZrO_2$ and $Y_2O_3$. The subscale also consisted of a $ZrO_2/Y_2O_3$ matrix, but contained a large number of finely dispersed metallic particles, essentially nickel and cobalt.

Although nickel and cobalt were present uniformly within the outer region of the metallic coating after hot dipping and annealing and before the conversion of Zr and Y into oxides, they were virtually absent from this same region after the selective oxidation treatment. X-ray diffraction analysis of the surface of the sample indicated that this outer oxide layer was formed exclusively of a mixture of monoclinic zirconia and yttria.

It is believed that the final distribution of elements across the duplex coating layer and the subsequent oxide morphology are determined largely by the conditions of the final selective oxidation treatment. We believe that oxidation proceeds as follows: The melt composition at the sample surface before the selective oxidation treatment consists largely of Zr and Ni, smaller concentrations of Y and Co, and virtually no Cr. Once oxygen is admitted at $P_{O2}=10^{-17}$ atm, Zr and Y atoms diffuse rapidly in the melt toward the outer oxygen/-metal interface to form a solid $ZrO_2/Y_2O_3$ mixture. The more noble elements (Ni and Co) are then excluded from the melt and accumulate in the metal side of the interface. The depletion of Zr from this melt increases the nickel content of the alloy and renders it more refractory. Once the coating alloy solidifies, atoms of all elements in the remaining metallic part of the coating become less mobile than in the molten state, and further oxidation proceeds as a solid state reaction. The continued growth of the $ZrO_2/Y_2O_3$ continues to promote a countercurrent solid state diffusion process in the metal side of the interface in which Zr and Y diffuse toward the interface, while nickel and cobalt diffuse away from the interface.

The profile indicated that, under the external $ZrO_2/Y_2O_3$ layer, nickel and cobalt exist as small particles embedded in the subscale composite layer. The reason for their existence in such a distribution within a matrix of the $ZrO_2/Y_2O_3$ subscale is not well understood. It should be emphasized that the weight fraction of nickel present in the coating layer, before oxidation, amounts to about 25%, which corresponds to about 20% in volume fraction This amount will increase in the subscale after the exclusion of nickel from the outer $ZrO_2/Y_2O_3$ external scale during selective oxidation. This substantial amount of nickel, added to cobalt diffusing from the substrate, is expected to remain trapped in the subscale layer of the coating during the completion of selective oxidation of Zr and Y.

The configuration and distribution of nickel and cobalt within this zone is likely to be determined by the mechanisms of oxidation of Zr and Y within the subscale zone. At least two possibilities exist:

(1) The concentration of nickel and cobalt in the metal ahead of the interface becomes very high as a result of their exclusion from the $ZrO_2/Y_2O_3$ scale initially formed from the melt. Some back-diffusion of both elements in the solid state is likely to continue during further exposure, but the remaining portion of both elements may be overrun by the advancing oxide/-metal interface. This is believed to be more probable than possibility (2).

(2) A transition from internal to external oxidation occurs. After the initial formation of a $ZrO_2/Y_2O_3$ layer at the surface, $ZrO_2$ internal oxide particles may form ahead of the interface when the concentration of dissolved oxygen and zirconium exceeds the solubility product necessary for their nucleation. Then, these particles may partially block further Zr-O reaction because the diffusion of oxygen atoms to the reaction front (of internal oxidation) can occur only in the channels between the particles that were previously precipitated. Further reaction at the reaction front may occur either by sideways growth of the existing particles, which requires a very small supersaturation, or by nucleation of a new particle. The sideways growth of the particles can thus lead to a compact oxide layer, which can entrap metallic constituents existing within the same region.

In general, regardless of the mechanism involved, in determining the morphology and distribution of the metallic particles within the subscale zone, the formation of such a ceramic/metallic composite layer between the outer ceramic layer and the inner metallic substrate is highly advantageous. This is due to its ability to reduce the stresses generated from the mismatch in coefficients of thermal expansion of the outer ceramic coating and the inner metallic substrate.

Coating adhesion was evaluated by exposure of several test specimens to 10 thermal cycles between 1000° C. and ambient temperature in air. The $ZrO_2/Y_2O_3$ coating on the alloy Co-10Cr-3Y remained completely adherent and showed no sign of spallation or cracking. Careful metallurgical examination along the whole length of the specimen did not reveal any sign of cracking. The coating appears completely pore free. Furthermore, microprobe analyses across this section showed that the distributions of Zr, Y, Ni, Co, and Cr were essentially the same as those samples that had not been cycled. The coatings are not equally effective on all substrates. For example, a similar $ZrO_2/Y_2O_3$ coating on the alloy MAR-M509 spalled after the second cycle.

It is believed that the presence of yttrium in both the Co-Cr-Y substrate and in the coating alloy promotes adhesion of the oxide layer.

Another significant observation is as follows: Zirconia-yttria mixtures have been prepared before but as far as we know no one has heretofore subjected an alloy of zirconium, yttrium and a more noble metal to selective oxidation. Heating the resulting $ZrO_2$-$Y_2O_3$-$M_2$ product at 1100° C. resulted in the in situ formation of the cubic or the stabilized form of $ZrO_2$.

EXAMPLE 3

The substrate metal was tool steel in the form of a rod. The coating alloy was a eutectic alloy containing 71.5% Ti and 28.5% Ni. This eutectic has a melting point of 942° C. The rod was dipped into this alloy at 1000° C. for 10 seconds and was removed and annealed for 5 hours at 800° C. It was then exposed to oxygen free nitrogen for 15 hours at 800° C. The nitrogen was passed slowly over the rod at atmospheric pressure. The resulting coating was continuous and adherent. The composition of the titanium nitride, $TiN_x$, depends upon the temperature and the nitrogen pressure.

EXAMPLE 4

Example 3 was repeated using mild steel as the substrate. A titanium nitride layer was applied.

The coatings of Examples 3 and 4 are useful because the treated surface is hard. This is especially helpful with mild steel which is inexpensive but soft. This provides a way of providing an inexpensive metal with a hard surface.

EXAMPLE 5

The same procedure was carried out as in Example 3 but at 650° C. The microns thick, was lighter in color than the coating of Example 3.

Darker colors obtained at higher temperatures indicated a stoichiometric composition, TiN.

Similar coatings were applied to stainless steel.

EXAMPLE 6

A eutectic alloy of 83% Zr and 17% Ni (melting point=961° C.) is employed. The substrate metal (tool steel) is dip coated at 1000° C., annealed 3 hours at 1000° C. and exposed to nitrogen as in Examples 3 and 5 at 800° C. A uniform adherent zirconium nitride coating 2 to 3 microns thick resulted.

EXAMPLE 7

A 47% Zr-52% Cu eutectic alloy, melting point 888° C. was used. Tool steel was dipped into the alloy for 10 seconds at 1000° C. and was withdrawn and annealed 5 hours at 1000° C. It was then exposed to nitrogen at one atmosphere for 50 hours at 800° C. A uniform adherent coating of zirconium nitride resulted.

An advantage of copper as the metal $M_2$ is that it is a good heat conductor which is helpful in carrying away heat (into the body of the tool) in cutting.

EXAMPLE 8

A 77% Ti-23% Cu alloy, a eutectic alloy, melting at 875° C. was used. Hot dipping was at 1027° C. for 10 seconds; annealing at 900° C. for 5 hours; exposure to $N_2$ at 900° C. for 100 hours. An adherent continuous titanium nitride coating resulted The substrate metal was high speed steel.

EXAMPLE 9

Tool steel was coated with a Ti-Ni alloy and annealed as in Example 3. The reactive gas species is methane which may be used with or without an inert gas diluent such as argon or helium. The coated steel rod is exposed to methane at 1000° C. for 20 hours. A hard, adherent coating of titanium carbide results.

EXAMPLE 10

The procedure of Example 9 may be repeated using $BH_3$ as the reactive gas species at a temperature above 700° C., e.g. >700° C. to 1000° C., for ten to twenty hours. A titanium boride coating is formed which is hard and adherent.

EXAMPLE 11

The procedure of Example 9 is repeated using silane, $Si\ H_4$, as the reactive gas species, with or without a diluting inert gas such as argon or helium. The temperature and time of exposure may be >700° C. to 1000° C. for ten to twenty hours. A titanium silicide coating is formed which is hard and adherent.

$TiO_2$-$M_2$ coatings may be applied to a substrate metal similarly using an oxygen atmosphere as in Examples 1 and 2. An advantage of $TiO_2$-$M_2$ coatings is that $TiO_2$ is resistant to attack by aqueous environments and it also inhibits diffusion of hydrogen into the substrate metal.

Among other considerations are the following:

The metal $M_2$ should be compatible with the substrate. For example, it should not form brittle intermetallic compound with metals of the substrate. Preferably it does not alter seriously the mechanical properties of the substrate and has a large range of solid solubility in the substrate. Also it preferably forms a low melting eutectic with $M_1$. Also it should not form a highly stable oxide, carbide, nitride, boride or silicide. For example, if $M_1$ is to be converted to an oxide, $M_2$ should not form a stable oxide under the conditions employed to form the $M_1$ oxide.

In the hot dipping method of application of an $M_1/M_2$ alloy, uneven surface application may be avoided or diminished by spinning and/or wiping.

The annealing step after application of the alloy or mixture of $M_1$ and $M_2$ should be carried out to secure a good bond between the alloy and the substrate.

Conversion of the alloy coating to the final product is preferably carried out by exposure to a slowly flowing stream of the reactive gas at a temperature and pressure sufficient to react the reactive gaseous molecule or compound with $M_1$ but not such as to react with $M_2$ It is also advantageous to employ a temperature slightly above the melting point of the coating alloy, e.g. slightly above its eutectic melting point. The presence of a liquid phase promotes migration of $M_1$ to the surface and displacement of $M_2$ in the outer layer.

If the temperature is below the melting point of the coating alloy and if the compound formed by $M_1$ and the reactive gaseous species grows fast, $M_2$ will be entrapped in the growing compound, thus bonding the particles of $M_1X_n$. In this case a cermet will be formed which may be advantageous, e.g. a W or Nb carbide cemented by cobalt or nickel.

It will therefore be apparent that a new and useful method of applying $M_1X_n$ coating to a metal substrate, and new and useful products are provided.

We claim:

1. A method of coating a metal substrate with a protective coating of a compound of zirconium and/or titanium and the element X, X being oxygen, nitrogen, carbon, boron or silicon, said method comprising:

(a) providing a metal substrate to be coated (b) providing a coating alloy containing a metal $M_1$ which is at least one of the metals zirconium and titanium, such alloy or mixture also containing a metal $M_2$ which forms no compound with X or which forms a compound with X which is less thermodynamically stable than a compound of $M_1$ and X (c) $M_1$ being present in the alloy in an amount not less than 50% by weight of the alloy and $M_2$ being present in a substantial amount sufficient to bind the protective coating to the substrate (d) applying such alloy to a surface of the substrate by dip coating or by application of a slurry of the alloy in a volatile liquid (e) then, after vaporization of volatile liquid if present, exposing the resulting coating to an elevated temperature in an atmosphere containing element X or a dissociable compound of X such that $M_1$ forms, and $M_2$ does not form a compound with X.

2. The method of claim 1 wherein after step (d) the coating is annealed.

3. The method of claim 1 wherein the substrate metal is a ferrous alloy.

4. The method of claim 1 wherein the substrate metal is a non-ferrous alloy.

5. The method of claim 1 wherein the substrate metal is a super alloy.

6. The method of claim 3 wherein the substrate is tool steel.

7. The method of claim 3 wherein the substrate is stainless steel.

8. The method of claim 1 wherein $M_1$ is zirconium.

9. The method of claim 8 wherein a small quantity of yttrium is included in the coating alloy or mixture.

10. The method of claim 1 wherein $M_1$ is titanium.

11. The method of claim 1 wherein $M_2$ is selected from the group nickel, cobalt and copper.

12. The method of claim 1 wherein the metal $M_1$ is present in the coating alloy or mixture in an amount not less than 50% by weight of the metal content.

13. The method of claim 1 wherein the coating material is a eutectic alloy of $M_1$ and $M_2$ and has a melting point substantially below that of the substrate.

* * * * *